US006802510B1

(12) United States Patent
Haber

(10) Patent No.: US 6,802,510 B1
(45) Date of Patent: Oct. 12, 2004

(54) CARD GAME

(76) Inventor: Jose Cherem Haber, Paseo de las Palmas 1260, Mexico D.F. (MX), 11000

( * ) Notice: Subject to any disclaimer, the term of this patent is extended or adjusted under 35 U.S.C. 154(b) by 0 days.

(21) Appl. No.: 10/376,791

(22) Filed: Feb. 28, 2003

(51) Int. Cl.[7] ..... A63F 1/00
(52) U.S. Cl. ..... 273/292; 273/309; 273/274
(58) Field of Search ..... 273/292, 274, 273/309; 463/12, 13

(56) References Cited

U.S. PATENT DOCUMENTS 5,494,295 A * 2/1996 Potter et al. ..... 273/292
5,810,354 A * 9/1998 Banyai ..... 273/292
5,810,663 A 9/1998 Bochichio et al.
5,863,041 A * 1/1999 Boylan et al. ..... 273/292
5,928,081 A 7/1999 Bochichio et al.
6,588,758 B1 * 7/2003 Lee ..... 273/292

* cited by examiner

*Primary Examiner*—Benjamin Layno
(74) *Attorney, Agent, or Firm*—Rob L. Phillips; Quirk & Tratos

(57) ABSTRACT

A wagering card game wherein a player places a first and second wager. In a live table game a player places a first and second wager. The first wager is placed on a poker ranking of either the player's five cards or the dealer's five cards in an attempt to select the higher ranking poker hand. Winning first wagers are paid according to a pay table corresponding to the poker ranking of the wagered upon winning hand. The second wager is placed on whether both the player's and dealer's hands are higher or lower than preestablished minimum and maximum poker rankings. Winning second wagers being paid at 3 to 1. Progressive jackpots may also be implemented with respect to the poker ranking of the wagered upon winning hand associated with the first wager. The embodiments of the present invention may also be implemented on an electronic gaming machine.

13 Claims, 4 Drawing Sheets

100

DEALER-PLAYER WINNERS

| HAND | PAYOUT |
|---|---|
| ROYAL FLUSH | 200 (PLUS 100% OF PROGRESSIVE JACKPOT) |
| STRAIGHT FLUSH | 50 (PLUS 10% OF PROGRESSIVE JACKPOT) |
| FOUR OF A KIND | 20 |
| FULL HOUSE | 12 |
| FLUSH | 10 |
| STRAIGHT | 6 |
| THREE OF A KIND | 3 |
| TWO PAIR | 2 |
| ONE PAIR | 1 |
| NO HAND | 1 |
| TIE | 10 |

FIG. 2

CARD GAME

FIELD OF INVENTION

The embodiments of the present invention relate to a card game. More particularly, a card game adapted for wagering in a casino or non-wagering environment.

BACKGROUND OF THE INVENTION

With the popularity of gambling, more and more jurisdictions are legalizing casinos and gaming in order to generate revenue. As such, casinos are in a neverending search for new games to peak the interest of their clientele. For example, popular new card games include Let it Ride, Carribean Stud Poker and Casino War. Wagering games utilizing playing cards are often popular with players because players are familiar with playing card suits and rankings and the associated odds. For example, Blackjack is the most popular card wagering game in existence and has been around for decades because of its simple rules and known odds.

Popular wagering games comprise common attributes such as ease of play, speed of play and reasonable odds for both the house and the player. Thus, casinos desire games of chance having the aforementioned characteristics. In addition, players desire opportunities at winning large jackpots in relation to small wagers. For example, Carribean Stud Poker is often times offered in association with a progressive jackpot. The progressive jackpot increases as a function of the wagers placed at multiple table locations offering the game. The progressive jackpot increases until a player at any of the multiple tables is dealt a hand of predetermined poker rank. In practice, the progressive jackpot associated with Carribean Stud Poker is won by a player who is dealt a Royal Flush. The progressive jackpot associated with Carribean Stud Poker can be in excess of $100,000 and requires only a $1 wager per hand played to possibly win.

While the characteristics of popular wagering games are based on common sense, many new wagering games continue to incorporate complex rules and multiple decision-making stages. As a result, many new games tend to warrant little play and fail as a result.

SUMMARY OF THE INVENTION

Accordingly, the embodiments of the present invention are quick and easy to play and provide reasonable odds for both the house and the player. Moreover, the wagering game disclosed herein is ideal for implementation of a progressive jackpot.

The game comprises two independent but equal wagers. A first wager is contingent upon the dealer or the player holding a higher poker hand. A second wager is contingent upon a poker rank of a player's hand and a dealer's hand being either lower or higher than preestablished poker rankings. At the start of the game, the player decides to first wager on either the dealer's or player's hand and to second wager on the dealer's and player's hand being higher or lower than preestablished poker rankings. In a first embodiment, the first wager is paid according to a preestablished pay table having payouts corresponding to the poker rank of the player's or dealer's hand depending on which hand the player selected and wagered on. By way of example, should the player wager on the dealer's hand and it is a higher hand than the player's hand the player wins.

Should the dealer's hand form a full house the player may receive 12 to 1 on the first wager as set forth in a preestablished pay table. The second high/low wager pays a winning player 3 to 1 on the wager. It should be understood that the order of the wagers is not important and the use of first wager and second wager herein is only meant to distinguish the different wagers.

In the manner described, the player has two opportunities to win. If the player wins both wagers, he is guaranteed a winning result, if the player wins only the first wager, he may win depending on the poker ranking of the hand wagered upon and if the player wins only the second wager he is guaranteed a win. Although the player appears to have a great likelihood of winning, the house does in fact retain the edge.

BRIEF DESCRIPTION OF THE DRAWINGS

FIG. 2 illustrates a pay table depicting payouts associated with a wager of a first embodiment of the present invention.

DETAILED DESCRIPTION

Figure 1:
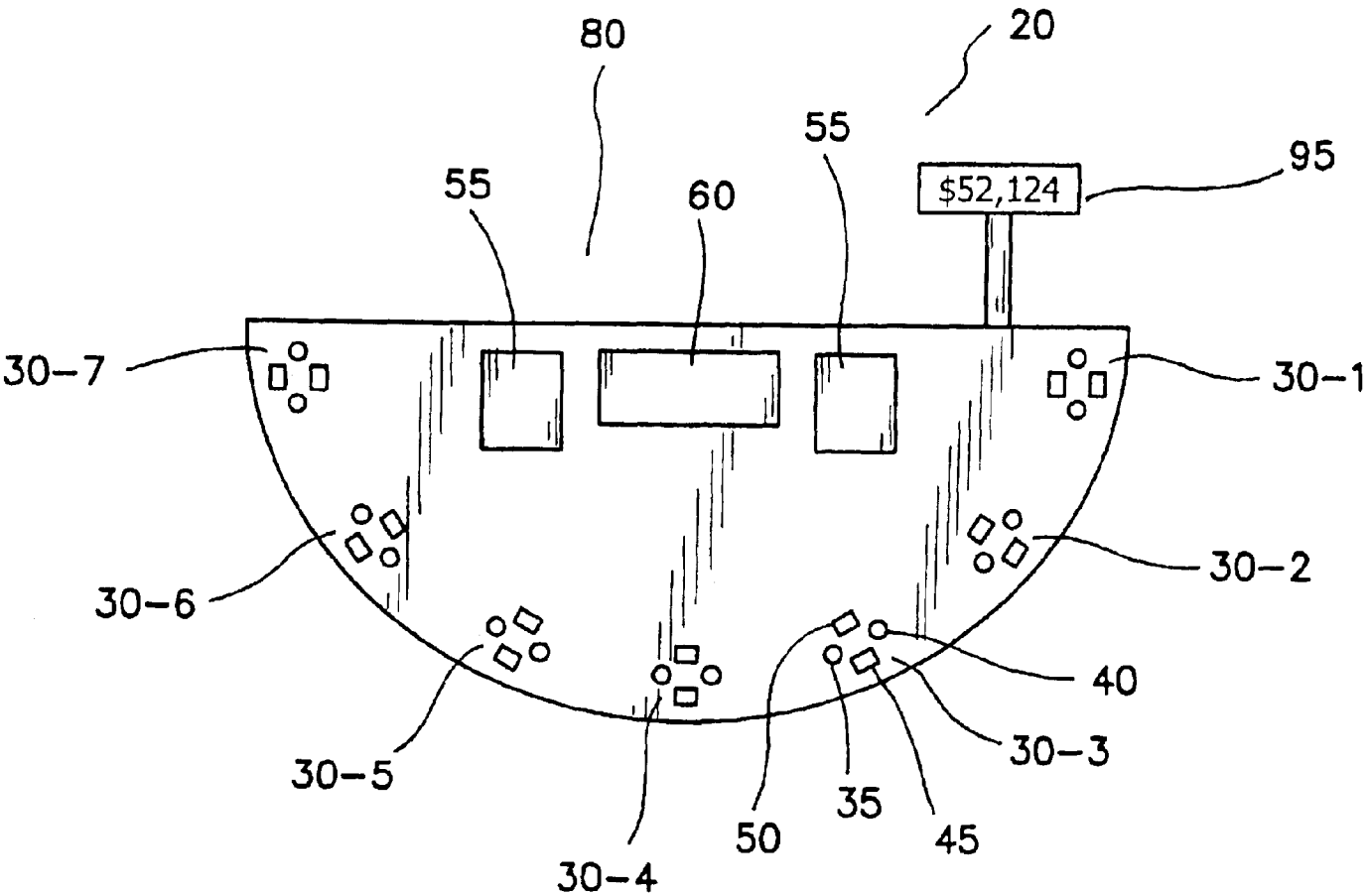
FIG. 1 illustrates a table layout for practicing the embodiments of the present invention.

As shown in FIG. 1, a table layout generally denoted as reference numeral 20 takes the overall appearance of a conventional Blackjack table. Seven player positions include player wager areas 30-1 through 30-7 comprising four wager positions. Each of the four wager positions comprises a high wager position 35, a low wager position 40, a player wager position 45 and a dealer wager position 50. Also incorporated on the layout 20 of FIG. 1 are one or more pay tables 55 incorporating payouts related to the dealer/player wager, the high/low wager and high/low poker rankings. In addition, a chip rack 60 for holding chips to pay winning wagers and to maintain collected losing wagers is incorporated adjacent to a dealer area 90.

Figure 1A:
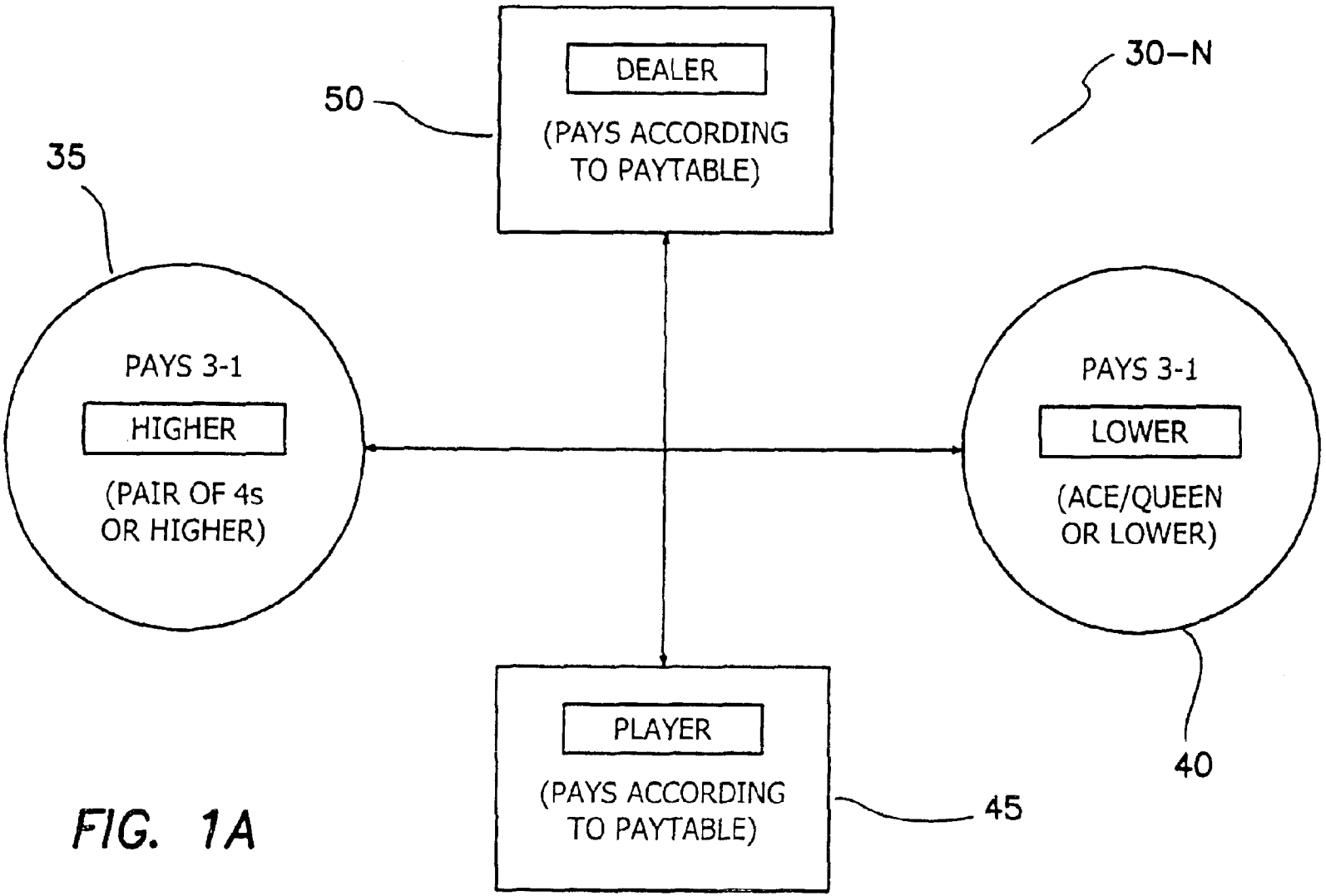
FIG. 1A illustrates a close-up of a player wagering area.

A single wager area 30-N, including the high wager position 35, the low wager position 40, the player wager position 45 and the dealer wager position 50, is shown in FIG. 1A. The first and second wager are independent of one another and must each be placed prior to every game played.

While not shown, it is contemplated that a table, over which the layout 20 is conformed, may support a card shuffler and/or card shoe for holding one or more decks of playing cards utilized to play the embodiments of the present invention. Also, a display device 95 for displaying an amount of a progressive jackpot may be supported by the table. Essentially any card playing accessories for facilitating play of the game may be placed on or near the table.

Although up to seven players may participate at a table offering the embodiments of the present invention, the description hereinafter will use, by way of example, a single player playing against a dealer. The player initially places two wagers of equal amounts. A first wager is related to whether the player believes the dealer or the player will be dealt the higher ranked poker hand. Therefore, the player is wagering on either the hand he or she is dealt or the hand the dealer is dealt. The player places the first wager in the player wager position 45 to wager on the poker ranking of his hand or places the first wager in the dealer wager position 50 to wager on the poker ranking of the dealer's hand.

A second wager, equal to the amount of the first wager, is related to whether both the player's and dealer's hands are higher or lower than preestablished minimum and maximum poker rankings, respectively. In a first embodiment, the preestablished minimum high poker ranking is a pair of fours and the preestablished maximum low poker ranking is Ace-Queen. The player places the second wager in the high wager position 35 to wager on both hands having poker rankings of a pair of fours or better or places the second wager in the low wager position 40 to wager on both hands having poker rankings of Ace-Queen or lower. Should either hand not fall within the preestablished parameters, the second wager is lost. While the wager positions are illustrated as circles and squares, they can take any shape desired.

Once the wagers are placed, the dealer deals each player and the dealer five face down cards from a single deck of cards. Alternatively, multiple decks may be used to reduce the number of shuffles required. The cards can be dealt in a conventional fashion such that the player and dealer are each dealt alternating single cards off the deck of shuffled cards until each has a complete five card hand. Alternatively, the player may be dealt five consecutive cards and the dealer may be dealt the next five consecutive cards from the shuffled deck. Either dealing method, or alternatives, are similarly available for multiple players.

Once the deal is complete, the dealer reveals his cards, then reveals the player's cards and compares the two hands to resolve the player's wagers. Should multiple players be seated, the players' wagers are resolved in a clockwise fashion starting from the player to the left most position of the dealer.

Payouts corresponding to a winning first wager are set forth in pay table 100 illustrated in FIG. 2. The payouts correspond to the poker ranking of the selected hand and are contingent upon the selected hand being the higher hand. The player only loses the first wager if the player fails to select the higher ranking poker hand between the player's hand and the dealer's hand. According to the pay table 100, a selected winning hand with no pair or one pair is paid 1 to 1 or even money. As the strength of the hands improve so to do the payouts. For example, a selected winning hand comprising four of a kind pays the player 20 to 1 on the wager. Also shown in FIG. 2 is a 10 to 1 payout associated with the players hand and dealer's hand resulting in a tie. The tie payout is paid regardless of the hand selected by the player. The payouts disclosed in FIG. 2 are based on an amount of the first wager and second wager being identical. A progressive jackpot is also set forth with respect to a straight flush and royal flush. Other wager schemes and payouts can be implemented as well.

As suggested above and as illustrated in FIG. 2, a progressive jackpot is also available with the embodiments of the present invention. In the first embodiment, a straight flush and royal flush may afford the player a portion of the progressive jackpot. For example, the straight flush may award the player 10% of the progressive jackpot and the royal flush may award the player 100% of the progressive jackpot. Progressive jackpots are formed by exacting a fixed amount of each wager placed on a group of networked tables offering the game. The fixed amount is the same regardless of the wager amount. By way of example, assuming a minimum wager of ten dollars ($10) results in a theoretical win of forty cents (40¢), twenty cents (20¢) may be retained as casino profit and the other twenty cents (20¢) may be applied to the progressive jackpot. The twenty cents (20¢) applied to the jackpot remains fixed regardless of the wager amount. Alternate disbursements may be implemented as well. The use of progressive jackpots is well known in the industry and need not be fully explored herein.

In the first embodiment, a payout corresponding to a winning second wager (e.g. player selects high or low) rewards the player 3 to 1 on his or her wager. A winning second wager payout is paid independently of the first wager. Therefore, the player only needs to select whether both hands will be higher or lowerthan the preestablished minimum and maximum poker rankings. Should one or both hands not meet the preestablished minimum or maximum poker rankings the second wager is lost.

Figure 3:
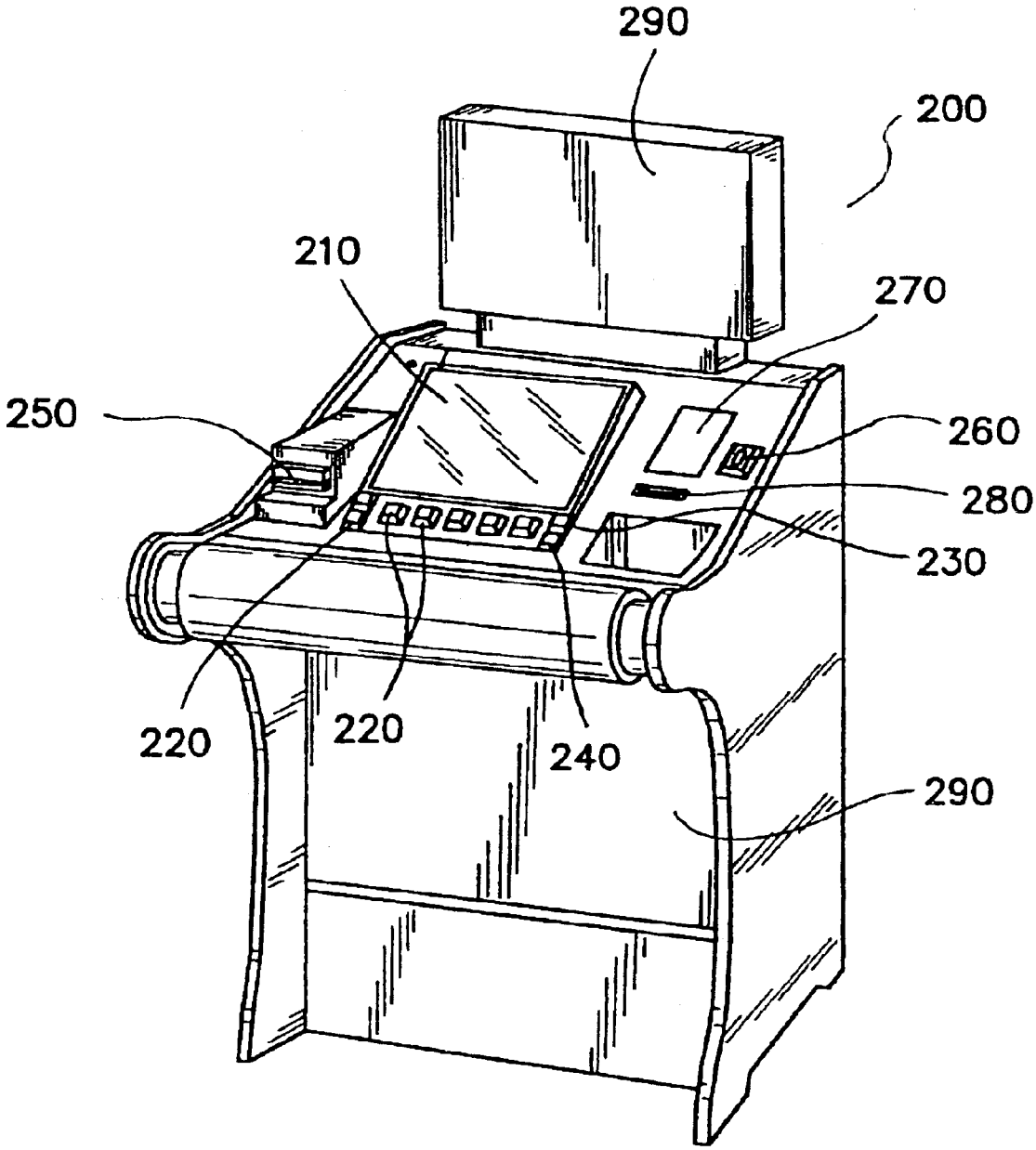
FIG. 3 illustrates an electronic gaming machine for facilitating an electronic version of the embodiments of the present invention.

FIG. 3 illustrates an electronic gaming machine, generally designated as reference numeral 200, of the type that may be used to implement the embodiments of the present invention in an electronic format. The external features of the gaming machine 200 include a display 210, wager selection buttons 220, a maximum coin button 230, a single coin wager 240, a card reader 250, a coin slot 260, a credit display 270 and a bill reader 280. While not shown, the gaming machine can also incorporate a ticket reader and printer for facilitating cashless play.

The operation of the gaming machine 200 is controlled by a microprocessor that communicates with an internal memory device and the external features of the machine. The microprocessor also incorporates, or communicates with, a random number generator which ensures the randomness of the cards dealt during the play of the game. Since the technology for controlling gaming machines is well known to those skilled in the art, the subtle details are not described herein.

Once implemented in the electronic format, a sample play of the game may proceed as described hereinafter. A player first inputs a wager by using the coin slot 260, bill reader 280 or the ticket reader. The wager can either be in the form of a single denomination wager (e.g. $5) or the player may insert a larger amount of money which the machine 200 displays on the credit display 270 so that the player can play on registered credit. On credit, the player may use the maximum coin button 230 or the single coin wager 240 to select the denomination of the wager. Since the embodiments of the present invention utilize two wagers, the processor of the gaming machine 200 may automatically double the player's inputted wager from a credit amount or may request that the player insert a second wager. Once the amount of the wager is set, the player depresses the wager selection buttons 220 to select the high/low wager and the player/dealer wager. The machine may also incorporate touchscreen technology to allow the player to select wagers by touching portions of the display 210. The processor then causes five face up player cards and five face up dealer cards to be displayed on the display 210. Based on the selected wagers, the displayed cards and a preestablished pay table stored in the memory device of the gaming machine 200 the processor determines the amount of any payouts. The payouts can be delivered in coins or may simply be added to the credit total of the player as displayed on the credit display 270.

In a conventional fashion the preestablished payouts of the gaming machine 200 may be depicted on an external surface 290 of the gaming machine 200. Typically gaming machines have printed or etched glass depicting, game names, game rules, pay tables and generally any information related to the game being facilitated by the machine.

While the payouts have been described in detail, it is understood that the payouts may be altered to match the standards of the casino offering the game. Moreover, the preestablished high/low hands may be altered as well. For example, the minimum high hand may be established as a pair of twos while the maximum low hand may be established as an Ace-King.

Obviously, many modifications and variations can be effected without departing from the spirit of the invention disclosed herein. It is therefore intended that the scope of the invention be determined solely by the claims appended hereto.

I claim:

1. A method of plying a wagering game wherein a dealer and one or more participating players receive multiple playing cards comprising:

providing a plurality of cards;

accepting placing a first wager and a second wager from one or more players, said first wager allowing a player a choice on placing said first wager on either a strength of the player's hand or a strength of the dealer's hand and said second wager allowing a player a choice on placing said second wager on the player's hand and the dealer's hand both being higher or lower than preestablished minimum or maximum poker rankings, respectively; and the dealer resolving each player's first wager and second wager independent of the other.

2. The method of claim 1 wherein the first wager is a winning wager if the player places the wager on the hand having the higher poker ranking.

3. The method of claim 1 wherein a first winning wager is paid according to a preestablished pay table including payouts corresponding to poker rankings.

4. The method of claim 1 wherein a second winning wager pays the player 3 to 1.

5. The method of claim 1 wherein the maximum poker ranking corresponding to the low wager is Ace-Queen and the minimum poker ranking associated with the high wager is a pair of fours.

6. The method of claim 1 wherein the amount of the first and second wager are equivalent.

7. The method of playing a wagering game of claim 1, wherein the game is facilitated by an electronic gaming device.

8. A method of playing a wagering card game comprising:

providing a plurality of cards;

accepting from one or more players placing a first and second wager, said first wager allowing a player a choice on placing said first wager on either a strength of the player's hand or a strength of the dealer's hand and said second wager allowing a player a choice on placing said second wager on the player's hand and the dealer's hand both being higher or lower than preestablished minimum or maximum poker rankings, respectively;

a dealer dealing each player and the dealer five cards; and said dealer resolving each player's first wager such that the first wager is a winning wager if the player places the wager on the hand having the higher poker ranking and said dealer resolving the second wager according to the preestablished minimum and maximum poker rankings.

9. The method of claim 8 wherein a first winning wager is paid according to a preestablished pay table including payouts corresponding to poker rankings.

10. The method of claim 8 wherein the second winning wager pays the player 3 to 1.

11. The method of claim 8 wherein the maximum poker ranking corresponding to the low wager is Ace-Queen and the minimum poker ranking associated with the high wager is a pair of fours.

12. The method of claim 8 wherein the amount of the first and second wager are equivalent.

13. The method of playing a wagering game of claim 8, wherein the game is facilitated by an electronic gaming device.

* * * * *

UNITED STATES PATENT AND TRADEMARK OFFICE

CERTIFICATE OF CORRECTION

PATENT NO. : 6,802,510 B1
DATED : October 12, 2004
INVENTOR(S) : Jose Cherem Haber It is certified that error appears in the above-identified patent and that said Letters Patent is hereby corrected as shown below:

Column 5,
Line 12, please change “plying” to -- playing --.

Signed and Sealed this

Eleventh Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,802,510 B1
DATED : October 12, 2004
INVENTOR(S) : Jose Cherem Haber It is certified that error appears in the above-identified patent and that said Letters Patent is hereby corrected as shown below:

Column 5,
Line 16, please delete “placing”.

Column 6,
Line 8, please delete “placing”.

Signed and Sealed this

Tenth Day of May, 2005

JON W. DUDAS
*Director of the United States Patent and Trademark Office*